US007322419B2

(12) United States Patent
Carmichael

(10) Patent No.: US 7,322,419 B2
(45) Date of Patent: Jan. 29, 2008

(54) CIRCULATING SUB AND METHOD

(75) Inventor: Mark Carmichael, St Mary (GB)

(73) Assignee: Specialised Petroleum Services Group Ltd., Westhill, Aberdeen (GB)

( * ) Notice: Subject to any disclaimer, the term of this patent is extended or adjusted under 35 U.S.C. 154(b) by 285 days.

(21) Appl. No.: 10/511,053

(22) PCT Filed: Apr. 16, 2003

(86) PCT No.: PCT/GB03/01596

§ 371 (c)(1),
(2), (4) Date: May 6, 2005

(87) PCT Pub. No.: WO03/089755

PCT Pub. Date: Oct. 30, 2003

(65) Prior Publication Data

US 2005/0217864 A1 Oct. 6, 2005

(30) Foreign Application Priority Data

Apr. 16, 2002 (GB) ..... 0208673.4

(51) Int. Cl.
*E21B 43/10* (2006.01)

(52) U.S. Cl. ..... 166/382; 166/334.1; 166/207

(58) Field of Classification Search ..... 166/277, 166/381, 384, 207, 332.1, 334.1, 237, 240, 166/373, 386
See application file for complete search history.

(56) References Cited

U.S. PATENT DOCUMENTS 2,627,891 A * 2/1953 Clark ..... 72/119
2,858,099 A * 10/1958 Althouse, Jr. et al. ..... 251/347
3,519,075 A * 7/1970 Mullins ..... 166/150
3,907,046 A * 9/1975 Gaylord ..... 175/235
4,047,564 A * 9/1977 Nix et al. ..... 166/72
4,962,815 A * 10/1990 Schultz et al. ..... 166/387
5,392,862 A 2/1995 Swearingen
6,152,228 A * 11/2000 Carmichael ..... 166/312
6,161,632 A 12/2000 Hovden
6,279,657 B1 * 8/2001 Carmichael et al. ..... 166/311
6,527,049 B2 * 3/2003 Metcalfe et al. ..... 166/277

(Continued)

FOREIGN PATENT DOCUMENTS

| | | |
|---|---|---|
| GB | 2272923 | 6/1994 |
| GB | 2307932 | 6/1997 |
| SU | 1469094 A1 | 3/1989 |
| WO | WO 00/37771 A1 * | 6/2000 |

*Primary Examiner*—David Bagnell
*Assistant Examiner*—David Andrews
(74) *Attorney, Agent, or Firm*—C. Dean Domingue; Robert L. Waddell; Ted M. Anthony

(57) ABSTRACT

A control sub for use with a hydraulically operated downhole tool. In an embodiment, the sub comprises an outer sleeve connected to a work string and an inner sleeve slidably engaged to the outer sleeve by matching hex profiles, connected to the downhole tool. Radial ports in the outer sleeve provide selective circulation of fluid from the tool and by closing these ports with the sleeve fluid pressure in to the downhole tool can be controlled. Closure is effected by setting down weight on the sub against the tool. An indexing mechanism is also described to keep the tool in a configuration, which maintains pressure on the tool. The sub is suitable for use with an expander tool.

24 Claims, 5 Drawing Sheets

U.S. PATENT DOCUMENTS 6,543,552 B1 * 4/2003 Metcalfe et al. ..... 175/57
7,086,477 B2 * 8/2006 Duggan ..... 166/380
2004/0045720 A1 * 3/2004 Duggan ..... 166/384
2006/0185852 A1 * 8/2006 Ross et al. ..... 166/332.4

* cited by examiner

CIRCULATING SUB AND METHOD

CROSSREFERENCE TO RELATED APPLICATIONS

This application claims priority from PCT/GB03/01596, having an international filing date of 14 Apr. 2003, and a priority date of 16 Apr. 2002.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not applicable

BACKGROUND OF THE INVENTION

The present invention relates to hydraulically operated downhole tools and in particular, though not exclusively, to a control sub to provide selective control of a hydraulically operated expander tool for tubulars.

It is known in the art to utilise the pressure of fluid pumped through a work string in a well bore to control a hydraulically activated tool in the well bore. For instance, when expanding tubulars such as slotted, screen or solid pipe a rotary expander may be used. These expanders have a cone head with an outer diameter greater than the diameter of the tubular. On the tool are arranged hydraulically operated rollers. When mounted on the end of a work string and inserted into a tubular, hydraulic pressure introduced to the expander tool will force the cone through the tubular and with the aid of the rollers the tubular will be expanded to the diameter of the expander tool.

The hydraulic pressure to operate these tools is typically supplied from the surface of the well bore by pumps. Due to the distances of travel to the location of the expander tool it is difficult to control the operation of the expander tool and, in particular, to provide a constant pressure to give a uniform control and therefore expansion of the tubular in the well bore. It is also difficult to start and/or stop the expander tool at desired locations in the well bore.

It has been recognised that being able to control the flow of hydraulic fluid adjacent a hydraulically operated downhole tool would be advantageous. U.S. Pat. No. 5,392,862 describes a drilling mud flow control sub that provides the necessary fluid flow and pressure to activate an expanding remedial tool such as an underreamer, section mill or other cutting tool. The sub consists of a cylindrical sub assembly housing forming a first upstream end and a second downstream end. The housing is threadably connected between a drill string at its first upstream end and a tool at its downstream end. Intermediate the upstream and downstream ends is located a drop ball seat so that insertion of a drop ball will prevent hydraulic fluid flow to the tool. A rupture disc is affixed to a hole formed in the control sub wall normal to the sub axis, above the drop ball seat, so that when obstructed fluid is shunted from the sub.

This flow control sub provides means to terminate fluid flow to the tools hydraulically operating mechanism while allowing fluid circulation through the sub when the tool is deactivated 'while tripping' and/or rotating the drill string. However a major disadvantage of this tool is in the single function operation i.e. in turning the hydraulic mechanism off. There is no selective control of the tool. Additionally when hydraulic fluid is applied to the tool through the sub the pressure of this fluid can only be controlled from the surface as with the prior art systems. Further a disadvantage is in the length of time taken for the drop ball to reach the seat and the associated difficulties if the single ball does not locate correctly in the seat.

It is an object of at least one embodiment of the present invention to provide a control sub for use with a hydraulically operated downhole tool which allows the tool to be operated in selective on and off configurations.

It is a further object of at least one embodiment of the present invention to provide a control sub for use with a hydraulically operated downhole tool which allows control of the hydraulic pressure delivered to the tool.

It is a yet further object of at least one embodiment of the present invention to provide a control sub for use with a hydraulically operated downhole tool which allows selective control of fluid circulation when the tool is run in or tripped from the well.

It is a still further object of the present invention to provide a method of controlling hydraulic pressure to a hydraulically operated downhole tool in a well bore.

BRIEF SUMMARY OF THE INVENTION

According to a first aspect of the present invention there is provided a control sub for use with a hydraulically operated downhole tool, comprising a tubular assembly having a through passage between an inlet and a first outlet, the inlet being adapted for connection on a workstring, the first outlet being adapted for connection to a hydraulically operated downhole tool, one or more radial outlets extending generally transversely of the tubular assembly, an obturating member moveable between a first position permitting fluid flow through the one or more radial outlets and a second position closing the one or more radial outlets, wherein the obturating member is moved from the first position to the second position by a compressive force applied from the tool.

It will be appreciated that release of the compressive force will open the one or more radial outlets and thus by varying the compressive force applied from the tool the amount of fluid circulated radially out of the sub can be controlled. Preferably the cross-sectional area of the first outlet is greater than the cross-sectional area of the second outlet. By varying the circulation of fluid radially from the sub the fluid exiting the sub through the first outlet can be varied. This fluid exiting the first outlet controls the hydraulic pressure applied to the tool and therefore the operation of the tool.

Preferably the compressive force occurs from the downhole tool remaining static relative to movement of the workstring and the control sub. Thus the control sub acts in a similar manner to weight set tools but provides control as weight is set.

Preferably the tubular assembly comprises an inner sleeve and an outer sleeve, sealingly engaged to each other. Preferably the outer sleeve is adapted to connect to the work string and the inner sleeve is adapted to connect to the tool. More preferably the inner and outer sleeves include mutually engageable faces so that the sleeves may be axially slideable in relation to each other over a fixed distance.

Preferably also the obturating member is a sleeve. Advantageously the sleeve is coupled to the inner sleeve of the tubular assembly. Preferably the obturating member is also axially slideable within the tubular assembly.

Preferably the one or more radial ports are located on the outer sleeve. Advantageously matching radial ports are located on the obturating member such that under compression each set of radial ports align to allow fluid to flow radially from the sub.

Preferably an outer surface of the inner sleeve includes a portion having a polygonal cross-section. Preferably also an inner surface of the outer sleeve has a matching polygonal cross-section. These matching sections ensure that when the work string is rotated the sub is rotated and with it the hydraulically operated tool. More preferably the polygonal cross section is a hex cross-section.

Preferably also the sub includes an indexing mechanism. The indexing mechanism may comprise mutually engageable formations on the inner and outer sleeves. Preferably the engagement formations comprise a member and a recess in which the member may be engaged. The member may comprise a pin and the recess may comprise a slot. Preferably, one of the member and the pin is mounted on the outer sleeve and the other is mounted on the inner sleeve. Typically the slot extends circumferentially around the respective sleeve and the pin may move circumferentially with respect to the slot.

Preferably the slot and/or pin is configured such that the pin and slot move in only one direction to each other when engaged and operated.

Preferably also the slot includes one or more longitudinal profiles as offshoots from the circumferential path. When the pin is located in such a profile, the sleeves may move relative to each other to effect the relocation of the obturating member from one position to another.

According to a second aspect of the present invention there is provided a method of controlling a hydraulically operated downhole tool in a well bore, the method comprising the steps:

(a) mounting above the tool on a work string a control sub, the sub including a first outlet to the tool and one or more radial outlets through which fluid within the work string will flow when not obstructed by an obturating member, the obturating member being moveable under a compressive force from the tool;

(b) running the tool into a well bore and locating the tool on a formation in the well bore;

(c) compressing the control sub by setting down weight on the tool;

(d) using the compressive force to move the obturating member and thereby control the fluid flow through the radial outlets, regulating the fluid pressure from the first outlet to hydraulically control the tool.

Preferably the method includes the step of running the tool in the well bore with the radial outlets in an open position and circulating fluid within the well bore.

Preferably the method includes the step of indexing the sleeves with respect to each other to move a pin in a sleeve within a recess of the other sleeve. Further steps may therefore include locating the pin in a position wherein the compressive force may be released and the radial ports may selectively be in an open or closed position.

Preferably also the method may include the steps of picking up and setting down the weight of the string repeatedly to cycle opening and closing of the radial outlets and thus provide a selective continuous 'on' and 'off' operation of the tool.

BRIEF DESCRIPTION OF THE DRAWINGS

Embodiments of the present invention will now be described, by way of example only, with reference to the accompanying drawings of which.

DETAILED DESCRIPTION OF THE INVENTION

Figure 1A:
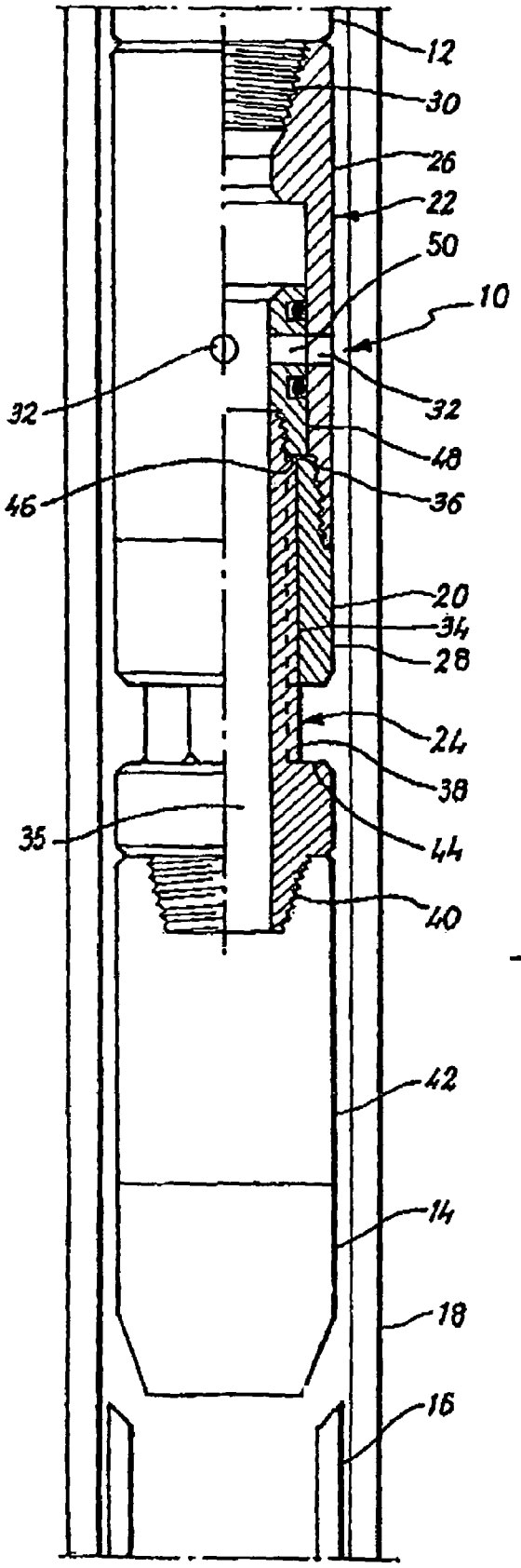
FIGS. 1 (*a*) to (*d*) are a series of part cross-sectional schematic views of a control sub, according to an embodiment of the present invention, in a work string with an expander tool illustrating the operating positions of the control sub during expansion of a pipe.
Figure 1B:
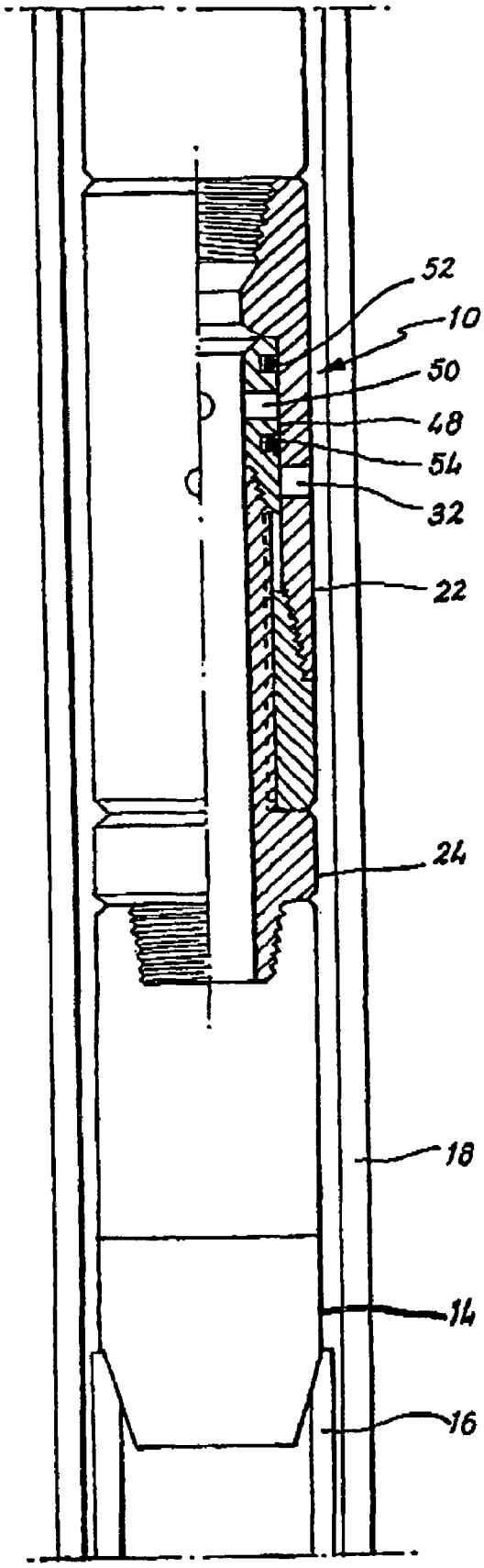
Figure 1C:
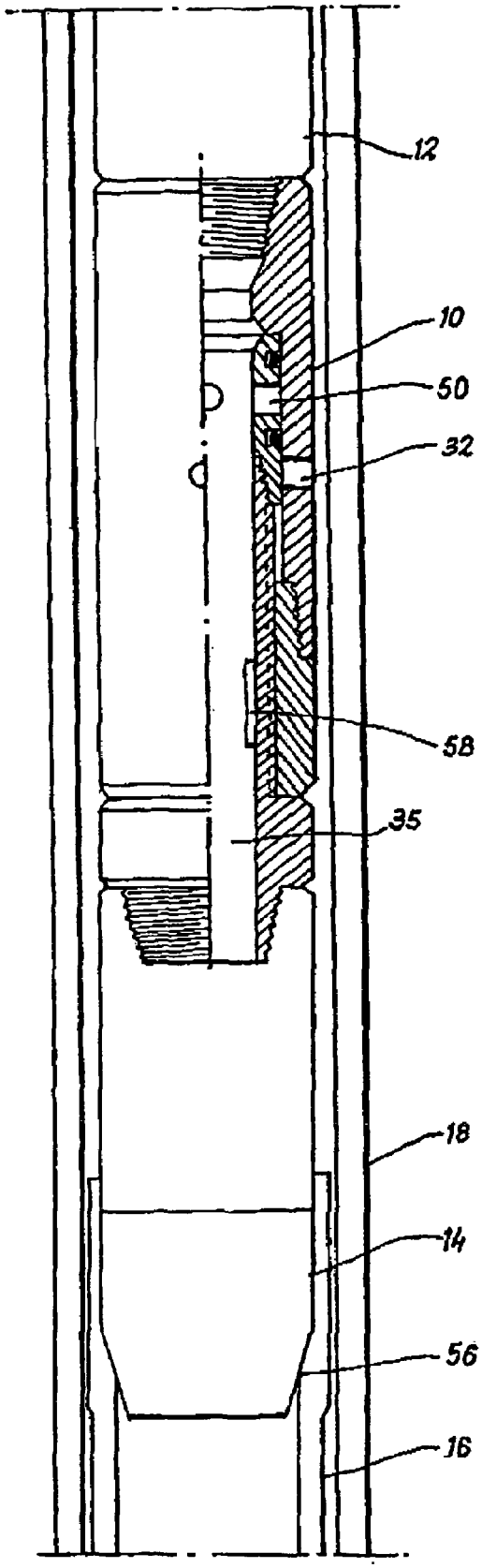
Figure 1D:
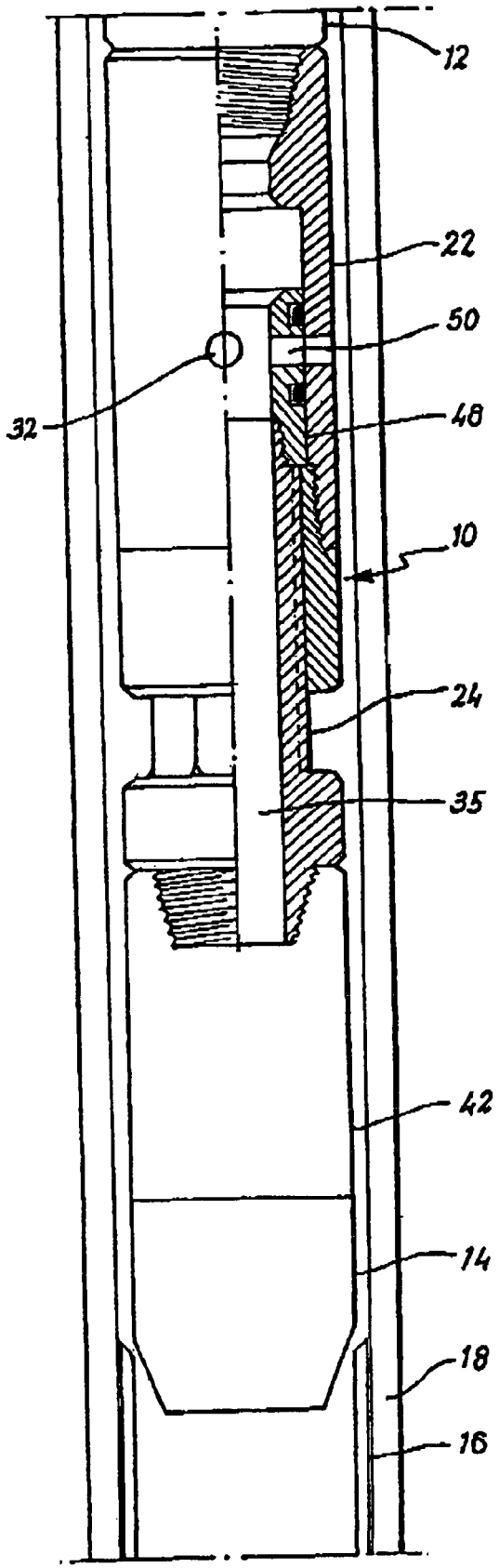

Reference is initially made to FIGS. 1 (*a*) to (*d*) of the drawings which illustrates a control sub, generally indicated by Reference Numeral 10 according to an embodiment of the present invention, in a work string 12 with an expander tool 14 illustrating the operating positions of the control sub 10 during expansion of a pipe 16 within a casing 18 of a well bore.

With specific reference to FIG. 1 (*a*), control sub 10 comprises a tubular body 20 having an outer sleeve 22 and an inner sleeve 24. Outer sleeve 22 is of two-part construction, having an upper portion 26 and a lower portion 28. Upper portion 26 includes a threadable portion 30 for connection of the sub 10 to a work string 12. Upper portion 26 includes four apertures 32 circumferentially arranged around the sleeve 22 to provide access through the sleeve 22. Lower portion 28 is threadably attached to upper portion 26. Lower portion 28 has an inner surface 34, which is hexagonal in cross-section. When threaded together the upper 26 and lower 28 portions of the outer sleeve 22 provide a lip 36 whose purpose will be described hereinafter.

Inner sleeve 24 includes a central bore 35 through which fluid may pass through the control sub 10. Inner sleeve 24 has an outer surface 38 having a hexagonal cross-section to match the inner surface 34 of the outer sleeve 22. Inner sleeve 24 further provides a threadable connection 40 at the base of the sub 10 for connection to an adapter 42 for the expander tool 14. Beside the threadable connection 40 is located a stop 44.

The upper end of inner sleeve 24 is threadably connected to an obturating sleeve 48. Obturating sleeve 48 is located within the inner bore 35 of the control sub 10. Obturating member 48 includes a matching set of apertures 50 to those apertures 32 in the outer sleeve 22. It will be appreciated by those skilled in the art that the size and dimensions of the apertures 50 could be varied to provide a flow profile to regulate flow through the apertures 32 of the outer sleeve 22. Further at a lower end of sleeve 48 is located a lip 46.

In use, the control sub 10 is mounted at the end of a work string 12 by threadable connection 30. An expander tool 14 is located onto the control sub via a threadable connection 40 with an optional adapter 42. As seen in FIG. 1 (*a*), when mounted the lips 36,46 of the outer sleeve 22 and obturating sleeve 48 respectively abut so that the inner sleeve 24 and obturating sleeve 48 are supported from the outer sleeve 24. In this first position of the obturating sleeve 48 the apertures 50 and 32 are aligned to provide a radial port for the expulsion of fluid radially from the sub 10 towards the casing 18. This is the configuration chosen for running the work string into the well and thus fluid can circulate from the sub via the inner bore 35 and the radial port provided by the apertures 32, 50.

Reference is now made to FIG. 1 (*b*) of the drawings wherein the work string has been run in the well bore through the casing 18 and the expander tool 14 has now located on a pipe 16 which requires to be expanded radially. When the expander tool 14 reaches the pipe, the expander tool will be stopped and the weight of the string will bear down upon the tool such that the tool 14 provides a compressive force onto the sub 10. The compression force will move the inner sleeve 24 relative to the outer sleeve 22, such that the inner sleeve 24 remains static and the outer sleeve 22 is shifted relatively downwards. This shift of the sleeves 22 and 24 provides an apparent shift of the obturating sleeve 48 such that the apertures 32, 50 are now mis-aligned. Fluid flow is now prevented from exiting the tool radially through the apertures 32, 50. Further fluid is prevented from escaping between the sleeves 22, 24 by virtue of the o-rings 52, 54 located on either side of the aperture 50 of the obturating sleeve 48.

Reference is now made to FIG. 1 (*c*) of the drawings wherein the sub 10 is held in compression. The expander tool 14 has been pressured up and no pumping of fluid through the inner bore 35 is required to maintain the expander tool in the actuated position unless a bleed is located in the expander tool 14. Pipe 16 is expanded by virtue of a cone 56 of the tool entering the pipe 16 and forcing the pipe to expand to a diameter equal to the actuated expander tool 14. Expander tool 14 is operated from a constant pressure of fluid delivered through the inner bore 35. Pipe 16 can become sealingly engaged to the casing in this operation. Alternatively, there may be annulus remaining between pipe 16 and casing 18.

It will be appreciated by those skilled in the art that any type of hydraulically operated expander tool could be used in this configuration and thus, a full description of an expander tool is absent so as not to limit the present invention.

As the expander tool expands the pipe it maintains a compressive force on the sub 10 so that the ports 32, 50 remain mis-aligned for the pressure to be maintained constantly through the inner bore 35. In a preferred embodiment of the present invention there is located within the bore 35 a sensor 58. Sensor 58 is a downhole pressure memory gauge which monitors the pressure of the hydraulic fluid through the bore 35. This can be used to determine that a constant hydraulic pressure has been exerted on the expander tool to monitor the expansion of the pipe 16. It will further be appreciated that if the pressure within the bore 35 requires to be adjusted, weight can be released from the string 12 thereby reducing the compressive force from the expander tool 14 such that some alignment of the apertures 32, 50 occurs and a small radial expulsion of fluid from the sub 10 may occur to control the pressure within the bore 35.

When the pipe 16 is fully expanded in the casing 18 the expander tool 14 can be pulled from the well by "tripping" the sub 10 on the work string 12 from the casing 18. As the expander tool 14 does not abut the surface of the pipe 16 when the pipe 16 is expanded, as shown in FIG. 1 (*d*), there is no weight bearing facility for the expander tool 14 and thus a compressive force on the sub 10 is released. When the compressive force is released, the inner sleeve 24 drops in relation to the outer sleeve 22 and thereby causes the obturating sleeve 48 to relocate to the first position wherein the apertures 32 and 50 are now realigned to provide a radial port for hydraulic fluid within the inner bore 35 to pass from the sub 10 into the annulus created between the sub 10 and the casing 18. Thus, as the tool 14 is pulled out of the hole, fluid can circulate within the well bore. Control sub 10 is thus in tension during this operation.

Figure 2:
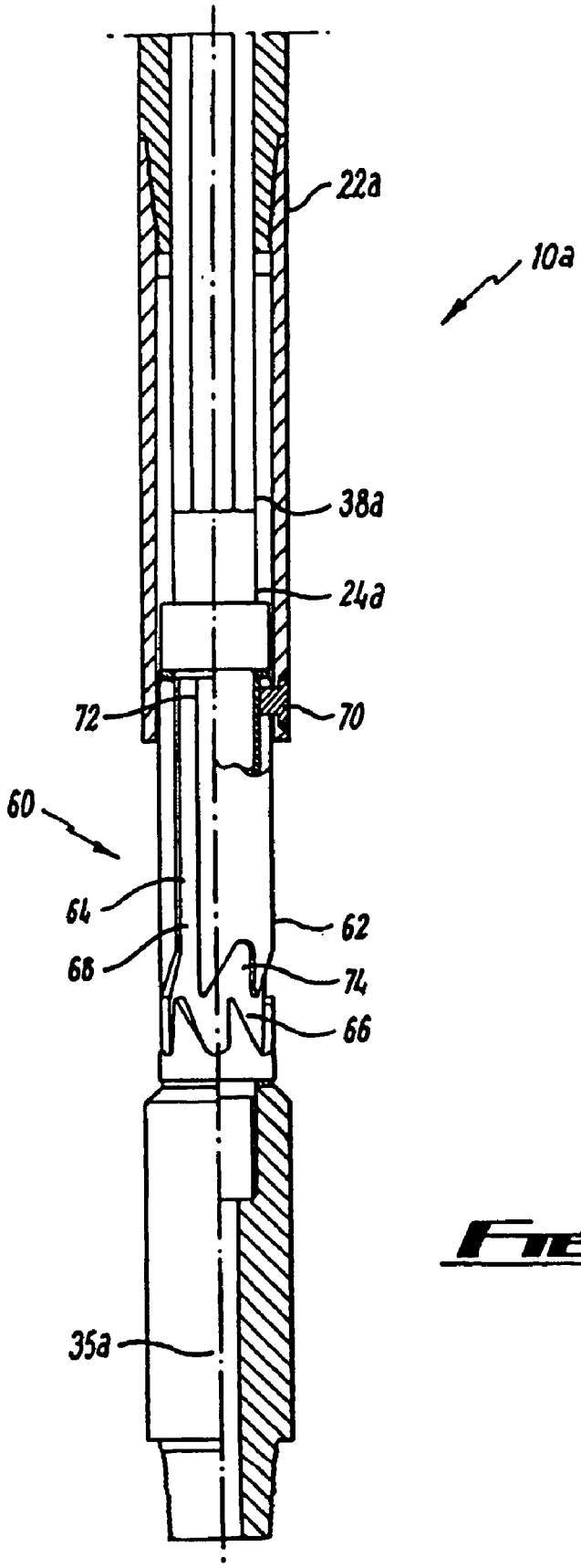
FIG. 2 is an illustration of an indexing mechanism showing the outer surface of an inner sleeve and, in cross-section, the outer sleeve of a control sub according to a further embodiment of the present invention.

Reference is now made to FIG. 2 of the drawings, which illustrates an additional feature of the sub 10, provided in a further embodiment of the present invention. Like parts to those of FIG. 1 have been given the same Reference Numeral but are now suffixed 'a'.

In this embodiment the sub 10 is provided within an indexing mechanism generally indicated by Reference Numeral 60. Indexing mechanism 60 comprises an index sleeve 62 located on the inner sleeve 24 on the sub 10*a*. On the outer surface 38*a* there is located a profile 64. Profile 64 is a key providing a lower 66 circumferential arrangement of v-grooves and on every second groove there is located a longitudinal portion 68. On the outer sleeve 22*a* there is located one or more index pins 70. In the embodiment shown there is one index pin 70. Index pin 70 is arranged to project towards the inner bore 35*a* and locate within the profile 64. The pin 70 may move to any position within the profile 64 as long as it remains in the path provided around the lower profile 66 or is located into one of the longitudinal portions 68.

In operation, a sub 10*a* including the index mechanism 60 would be run into a casing as described herein with reference to FIG. 1. When the tool has landed on a formation in well bore, the pin 70, originally located in the longitudinal portion 68, will be driven along the slot and into the circumferential portion 66.

When the pin 70 is located at a top 72 of the longitudinal portion 68, the radial ports (not shown) in the outer and inner sleeves 22*a* and 24*a* (alike to the ports 32 and 50 in the tool 10 of FIGS. 1*a* to 1*d*) are aligned and fluid may circulate from the sub 10*a* as described herein before.

When the index pin 70 is located within the circumferential portion 66, the radial ports are closed as described herein with reference to FIGS. 1 (*b*) and 1 (*c*). As the circumferential slot 66 includes a number of v-grooves, each v-groove provides a cavity 74 into which the pin 70 can locate and be held relative to the sleeve 62. When the pin 70 is located in the cavity 74, the sub 10*a* can be picked up on the string 12*a* and thus the expander tool can be tripped from the well bore with the radial ports in a closed position. By compression and release of the sub in a reciprocating action, the index pin 70 can be moved around the circumferential profile 66 and thereby the position of the radial ports, can be selected to provide controlled operation of the tool 14*a*.

In the embodiment shown in FIG. 2, the sub 10*a* may be picked up while the radial ports remain closed and only on every second time the tool is picked up will the ports become open by virtue of the pin moving from the cavity 74 into the slot 68.

A principal advantage of the present invention is that it provides a control sub for a hydraulically operated downhole tool, which controls the hydraulic pressure to the tool adjacent to the sub. A further advantage of the present invention is that it provides selective operation of a hydraulically operated downhole tool while the tool is in the well bore.

By use of an indexing mechanism, a further advantage of the present invention is that it ensures that pressure is maintained upon the expander tool without the risk of the radial ports opening and thus the expander tool can be reciprocated within a well bore without loss of hydraulic pressure upon the expander tool.

Modifications may be made to the invention herein described without departing from the scope thereof. For example, it will be appreciated that any number of apertures can be arranged to provide radial expulsion of the fluid for circulation from the sub. Additionally, these ports may be arranged to expel fluid in a direction substantially upwards or downwards in relation to the casing. Further, it will be appreciated that the control sub of the present invention could be used in a well bore, which is vertical, inclined or horizontal.

The invention claimed is:

1. A system for controlling a hydraulically operated downhole tool for use in a well bore, the hydraulically operated tool including a hydraulically operating mechanism controlled by fluid pressure, the system comprising:

a control sub comprising a tubular assembly having an inner sleeve and an outer sleeve sealingly engaged to each other and a through passage between an inlet and a first outlet, the inlet being adapted for connection on a workstring, the first outlet being adapted for connection to the hydraulically operated tool, one or more radial outlets extending generally transversely of the tubular assembly, an obturating member moveable between a first position permitting fluid flow through the one or more radial outlets and a second position closing the one or more radial outlets, wherein the obturating member is moved from the first position to the second position by a compressive force applied from the hydraulically operated tool; and wherein movement of the obturating member regulates the fluid pressure from the first outlet to hydraulically control the hydraulically operated tool.

2. A system as claimed in claim 1 wherein a cross-sectional area of the first outlet is greater than a cross-sectional area of the/each radial outlet.

3. A system as claimed in claim 1 wherein the compressive force occurs from the hydraulically operated tool remaining static relative to movement of the workstring and the control sub.

4. A system as claimed in claim 1 wherein the outer sleeve is adapted to connect to the workstring and the inner sleeve is adapted to connect to the hydraulically operated tool.

5. A system as claimed in claim 1 wherein the inner and outer the sleeves include mutually engageable faces so that the sleeves may be axially slideable in relation to each other over a fixed distance.

6. A system as claimed in claim 1 wherein the obturating member is a sleeve, coupled to the inner sleeve of the tubular assembly.

7. A system as claimed in claim 1 wherein the one or more radial ports are located on the outer sleeve.

8. A system as claimed in claim 7 wherein matching radial ports are located on the obturating member such that under compression each set of radial ports align to allow fluid to flow radially from the sub.

9. A system as claimed in claim 1 wherein an outer surface of the inner sleeve includes a portion having a polygonal cross-section and an inner surface of the outer sleeve has a matching polygonal cross-section.

10. A system as claimed in claim 9 wherein the polygonal cross sections are hex cross-sections.

11. A system as claimed in claim 1 wherein the sub includes an indexing mechanism.

12. A system as claimed in claim 11 wherein the indexing mechanism comprises mutually engageable formations on the inner and outer sleeves.

13. A system as claimed in claim 12 wherein the engageable formations comprise at least one pin and a slot into which the pin(s) engage.

14. A system as claimed in claim 13 wherein the slot extends circumferentially around a surface of a sleeve to provide a circumferential path for the pin.

15. A system as claimed in claim 14 wherein the slot includes one or more longitudinal profiles as offshoots from the circumferential path to allow the sleeves to move relative to each other to effect the relocation of the obturating member from one position to another.

16. A system as claimed in claim 1 wherein the hydraulically operated tool is an expander tool.

17. A method of controlling a hydraulically operated downhole tool in a well bore, the method comprising the steps:

(a) mounting on a work string a hydraulically operated tool including a hydraulically operating mechanism controlled by fluid pressure and a control sub, the sub including a first outlet to the hydraulically operated tool and one or more radial outlets through which fluid within the workstring will flow when not obstructed by an obturating member, the obturating member being moveable under a compressive force from the hydraulically operated tool;

(b) running the work string into a well bore with the one or more radial ports of the control sub open;

(c) locating the hydraulically operated tool on a formation in the well bore;

(d) compressing the control sub by setting down weight on the hydraulically operated tool; and (e) using the compressive force to move the obturating member and thereby control the fluid flow through the radial outlets, regulating the fluid pressure from the first outlet and hydraulically controlling the hydraulically operated tool.

18. A method as claimed in claim 17 wherein the step of running the work string in the well bore with the radial outlets of the control sub in an open position also comprises circulating fluid within the well bore.

19. A method as claimed in claim 17 wherein the method includes the steps of picking up and setting down the weight of the string repeatedly to cycle opening and closing of the radial outlets and thus provide a selective continuous 'on' and 'off' operation of the hydraulically operated tool.

20. A method as claimed in claim 17, wherein the step of mounting the control sub on the work string comprises mounting a control sub having an inner sleeve and an outer sleeve sealingly engaged to each other.

21. A method of expanding a pipe within a casing of a well bore, the method comprising the steps:

(a) mounting on a work string an expander tool controlled by hydraulic fluid pressure and a control sub, the sub including a first outlet to the expander tool and one or more radial outlets through which fluid within the workstring will flow when not obstructed by an obturating member, the obturating member being moveable under a compressive force from the expander tool;

(b) running the work string into a well bore with the one or more radial outlets of the control sub open;

(c) locating the expander tool on a pipe to be expanded;

(d) compressing the control sub by setting down weight on the expander tool;

(e) using the compressive force to move the obturating member and thereby prevent fluid flow through the radial outlets;

(f) pressuring up the expander tool by fluid pressure from the first outlet; and (g) expanding the pipe using the expander tool at a constant fluid pressure while maintaining the compressive force on the sub.

22. A method as claimed in claim 21 wherein the step of running the work string in the well bore with the radial outlets of the control sub in an open position also comprises circulating fluid within the well bore.

23. A method as claimed in claim 21, wherein the step of mounting the control sub on the work string comprises mounting a control sub having an inner sleeve and an outer sleeve sealingly engaged to each other.

24. A system for controlling an expander tool for use in a well bore, the expander tool including a hydraulically operating mechanism controlled by fluid pressure, the system comprising:

a control sub comprising a tubular assembly having a through passage between an inlet and a first outlet, the inlet being adapted for connection on a workstring, the first outlet being adapted for connection to the expander tool, one or more radial outlets extending generally transversely of the tubular assembly, an obturating member moveable between a first position permitting fluid flow through the one or more radial outlets and a second position closing the one or more radial outlets, the obturating member being movable from the first position to the second position by a compressive force applied from the expander tool to regulate the fluid pressure from the first outlet to hydraulically control the expander tool; and wherein the sub includes an indexing mechanism to provide controlled operation of the expander tool by selection of the position of the radial ports relative to the obturating member.

* * * * *